US007770589B2

(12) United States Patent
Woodson

(10) Patent No.: US 7,770,589 B2
(45) Date of Patent: Aug. 10, 2010

(54) WATER POWERED EDUCTOR CLEANER

(75) Inventor: Damon Eric Woodson, Macon, GA (US)

(73) Assignee: The Southern Company, Atlanta, GA (US)

( * ) Notice: Subject to any disclaimer, the term of this patent is extended or adjusted under 35 U.S.C. 154(b) by 721 days.

(21) Appl. No.: 11/633,229

(22) Filed: Dec. 4, 2006

(65) Prior Publication Data

US 2007/0125406 A1 Jun. 7, 2007

Related U.S. Application Data

(60) Provisional application No. 60/741,624, filed on Dec. 2, 2005.

(51) Int. Cl.
*B08B 3/04* (2006.01)

(52) U.S. Cl. ..... 134/104.1; 134/166 R; 134/198

(58) Field of Classification Search ..... 134/104.1, 134/166 R, 166 C, 198
See application file for complete search history.

(56) References Cited

U.S. PATENT DOCUMENTS

| | | | | |
|---|---|---|---|---|
| 1,444,997 | A | 2/1923 | Anderson | |
| 1,479,271 | A | 1/1924 | Wolcott | |
| 1,697,584 | A * | 1/1929 | Aikins | 406/34 |
| 3,951,624 | A | 4/1976 | Snader | |
| 3,966,436 | A | 6/1976 | Archer | |
| 4,026,683 | A | 5/1977 | Snader et al. | |
| 4,390,284 | A * | 6/1983 | Hyde et al. | 366/165.5 |
| 4,968,330 | A | 11/1990 | Wolf et al. | |
| 5,009,677 | A | 4/1991 | Wolf et al. | |
| 5,334,238 | A | 8/1994 | Goodson et al. | |
| 5,361,830 | A * | 11/1994 | Wicks et al. | 166/51 |
| 5,752,533 | A * | 5/1998 | Edwards | 134/176 |
| 6,360,680 | B1 | 3/2002 | Breen et al. | |

FOREIGN PATENT DOCUMENTS

DE 138885 A * 11/1979

OTHER PUBLICATIONS

Abstract: DD 138885 A to Fendler, et al. Nov. 1979.*
Certified Translation: DD 138885 A to Fendler, et al. Nov. 1979.*

* cited by examiner

*Primary Examiner*—Michael Kornakov
*Assistant Examiner*—Naomi Birbach
(74) *Attorney, Agent, or Firm*—Seyed Kaveh E. Rashidi-Yazd, Esq.; Ryan A. Schneider, Esq.; Troutman Sanders LLP

(57) ABSTRACT

A water-powered eductor cleaner for removing accumulated matter from within a chamber of an eductor. The water-powered eductor cleaner includes an eductor cleaning system for separating accumulated matter from the inside walls of the eductor chamber. The eductor cleaning system utilizes a high-pressured water stream from within the eductor chamber to provide the energy to move the eductor cleaning system between the inside walls of the eductor chamber, thereby engaging and dislodging the accumulated matter.

12 Claims, 1 Drawing Sheet

WATER POWERED EDUCTOR CLEANER

CROSS REFERENCE TO RELATED APPLICATION

This application claims benefit, under 35 U.S.C. §119(e), of U.S. Provisional Application Ser. No. 60/741,624, filed 2 Dec. 2005, the entire contents and substance of which are hereby incorporated by reference.

BACKGROUND

1. Field of the Invention

The present invention relates generally to an eductor cleaner and, more specifically, to a water-powered eductor cleaner utilizing a pendulum cleaning device.

2. Description of Related Art

Eductors are used to convey material from one location to another. For example, as pressurized water is directed through a nozzle into a chamber or venturi of the eductor, a low pressure area is formed in the venturi. The low pressure area will "pull" air, water, ash, and any other free floating materials from the venturi towards the throat of the eductor. In other words, the low pressure area creates a vacuum that sucks materials from within the venturi to a subsequent location. For example, coal fired plants use eductors to move coal fly ash from small collection hoppers to larger storage areas.

As material is inserted into the eductor through a material intake, the material may come in contact with the pressurized water supplied via the nozzle. Many types of materials, such as coal fly ash (calcium carbonate), can become sticky when mixed with water. Unfortunately, the sticky material can begin to accumulate on the walls of the eductor. Further, the accumulating material can then subsequently clog the nozzle of the eductor, thereby interfering with the efficient use of the eductor. As the material continues to accumulate on the walls of the throat of the eductor, the low pressure area formed weakens, and can no longer pull materials out of the eductor.

To clean out the accumulated material on the walls and throat of the eductor, the eductor must be taken out of service so that the venturi can be scraped with a rod or hard brush. The process of cleaning out the venturi by scraping the accumulated materials off the walls and throat of the eductor can be hazardous, as such process requires an individual to enter a space-limiting and fall hazard environment.

To address the accumulation of dust and materials in other industries, rapping mechanisms have been used to remove the accumulation of materials from various devices. For example, electrostatic precipitators are often used to collect dust by utilizing an electrical charge (e.g., static electricity). The electrical charge attracts the dust particles that then accumulate near the location of the electrical charge. Subsequently, a rapping mechanism can be used to dislodge or knock-off the accumulated dust, which can then be disposed of properly.

U.S. Pat. No. 1,444,997 to Anderson discloses the use of chains or wires to decrease the amount of precipitated matter adhered thereto, so as to facilitate the removal of the precipitated matter from electrodes. Further, Anderson provides the process of shaking or raising and lowering an electrode to dislodge particulate matter that has attached to it. To collect the precipitated matter, the chains or wires are electrified to a high voltage to produce a corona, which charges the particles within gas moving by the chains or wires. The charged particles are then attracted to an electrically charged plate (e.g., electrode) having an opposite electric charge and being positioned near the chains or wires. The chains and wire, however, are not used as rapping mechanisms to dislodge the collected particles on the electrode. Instead, the electrode is shaken or raised and lowered to remove the accumulated matter. Further, when the chains or wire become dirty, they are cleaned by a separately powered device similar to a rapper.

Another electrostatic precipitator is disclosed in U.S. Pat. No. 1,479,271 to Wolcott. The electrostatic precipitator uses a jarring means to jar or agitate a screen, chain, or wire so that the high tension electrodes may also be vibrated, thereby dislodging material that has accumulated on the electrodes. The screen, chain, or wire is used to charge particulate matter by using a high voltage. The charged particulate matter is then attracted to an oppositely charged electrode.

U.S. Pat. Nos. 3,951,624 and 4,026,683 to Snader and Snader et al., respectively, disclose the use of a baffle that prevents particles from becoming lodged between a hopper and the baffle upon discharge of the particles from the hopper. Link chains of various lengths are used to meet the shape of a flexible portion to the sides of the hopper. Being flexible, the chains will move to permit accumulations of dust particles ahead of the chains to slide downward into a precipitator. Snader et al. further discloses a rapper assembly used to vibrate a rigid portion and a flexible portion to dislodge the dust particles thereon, causing the material to fall into the precipitator.

U.S. Pat. No. 3,966,436 to Archer discloses the clashing of certain elements of a discharge electrode in order to effectively remove accumulated particles that are attached thereon. Archer provides an improved discharge electrode that captures dust particles using an electrostatic charge, but can be cleaned by clashing certain parts of the electrode to remove the accumulated material.

Further, U.S. Pat. Nos. 4,968,330 and 5,009,667, both to Wolf et al., disclose subparts for an electrostatic precipitator having a chain screen made up of individual chains of varying lengths. Below the chain support is a cam that functions as a rapper by lifting the chain support and then allowing it to fall at periodic, predetermined times. Additionally, dust which collects on collecting electrodes is dislodged by rappers that jolt the electrodes. By lifting and dropping the chain support, the chain rapper permits the various chains to hit against each other, thereby permitting the dust that has accumulated on a distributor to pass through the chain screen into a hopper. The chains are designed to separate particles of varying sizes, but are not designed to actually clean the electrodes of the precipitator.

Yet another precipitator is disclosed in U.S. Pat. No. 5,334,238 to Goodson et al. A variation for dislodging particles is provided, wherein a plurality of flexible tubes are used for passing a stream of gas onto precipitator plates. As the stream of gas flows through the flexible tubes, it causes a natural reaction propelling the unrestrained tubes in random directions (often colliding with the wall or other internal structures) such that the exiting gas is directed primarily at the precipitator plates. As the exiting gas encounters the precipitator plates, the fine particles adhered to the plates are removed and carried away. An external blower is used to power the hosed during the cleaning process, which generally occurs after accumulation of materials has occurred.

Also, U.S. Pat. No. 6,360,680 to Breen et al. is directed toward a base furnace having plates used to accumulate particle matter. As disclosed, the plates are rapped at regular intervals; thereby releasing the fly ash attached to the plates, which then falls and collects in a reservoir.

While useful for their intended purposes, none of these devices can be used to adequately clean an eductor as described above. More specifically, an electrostatic precipitator would not be effective in an eductor using high-pressured water streams to create a low-pressure area for removing particulate matter from the chamber of the eductor, as the water flow would interfere with the electrically charged electrodes or plates. Further, most of the devices described above require a separate energy source for removing the accumulated material (e.g., for activating the rapper).

What is needed, therefore, is a self-cleaning water-powered eductor that prevents the accumulation of material within the venturi of the eductor. Moreover, what is needed is a water-powered eductor having a pendulum cleaning device that uses the energy from the water source to activate the pendulum motion, thus cleaning the inside of the eductor. A beneficial self-cleaning water-powered eductor should not use a separate energy source for removing accumulated materials within the eductor. Instead, the self-cleaning water-powered eductor should use the kinetic energy provided by the high-pressured water streams to initiate the pendulum cleaning device. It is to such a device that the present invention is primarily directed.

SUMMARY

Briefly described, in preferred form, the present invention is a water-powered eductor cleaner for removing accumulated matter from within a chamber of the eductor. The water-powered eductor cleaner includes an eductor cleaning system for separating accumulated matter from the inside walls of the eductor chamber, and a motive means to activate the system. The motive means of the present cleaner can be a high-pressured water stream and vaccum, the stream from within the eductor chamber to provide the energy to move the eductor cleaning system between the inside walls of the eductor chamber, thereby engaging and dislodging the accumulated matter.

Generally, the water-powered eductor includes a chamber (also referred to herein as a "venturi"), a throat positioned below the chamber, a water nozzle for providing a high-pressured water source as the motive means, a water inlet, an air inlet, and a material intake through which the particulate matter enters the eductor chamber, which then is transported to an external storage area via the throat of the eductor. The high-pressured water source can create a low-pressure area within the upper-portion of the chamber, such that a vacuum is created within the eductor chamber. The vacuum draws the particulate matter into the chamber through the material intake, where the particulate matter is then sucked out of the chamber and through the throat of the eductor, so that the particulate matter can be transferred to the external storage area. The vacuum created by the low-pressure area, however, does not on its own provide sufficient agitation to dislodge/pull particulate material that has accumulated to the side walls of the chamber. Such accumulated material has mixed with water, thereby creating a sticky mixture that clings to the side walls within the eductor chamber.

The eductor cleaning system of the present invention includes a pendulum cleaning device adapted to engage the inner side walls of the eductor chamber, so that the accumulated material is dislodged or knocked-off of the side walls of the eductor chamber. The removed material can then be drawn to the throat of the eductor via the vacuum created by the low-pressure area.

The pendulum cleaning device can include a mounting bar positioned near the upper portion of the eductor cleaner, a pivot attachment in communication with the mounting bar, a chain having a first end in communication with the pivot attachment, and a pendulum weight in communication with a second end of the chain. In operation, the high-pressured water source and the vacuum created by the low-pressure system undulates the chain of the pendulum cleaning device, such that the chain and pendulum weight swings about the pivot attachment. As the chain and pendulum weight moves within the eductor chamber, the chain and pendulum weight raps the inner side walls of the eductor chamber, thereby removing accumulated matter. Accordingly, the eductor chamber remains relatively clean, such that the eductor does not need to be deactivated to remove accumulated matter.

These and other objects, features and advantages of the present invention will become more apparent upon reading the following specification in conjunction with the accompanying drawings.

DETAILED DESCRIPTION

Figure 1:
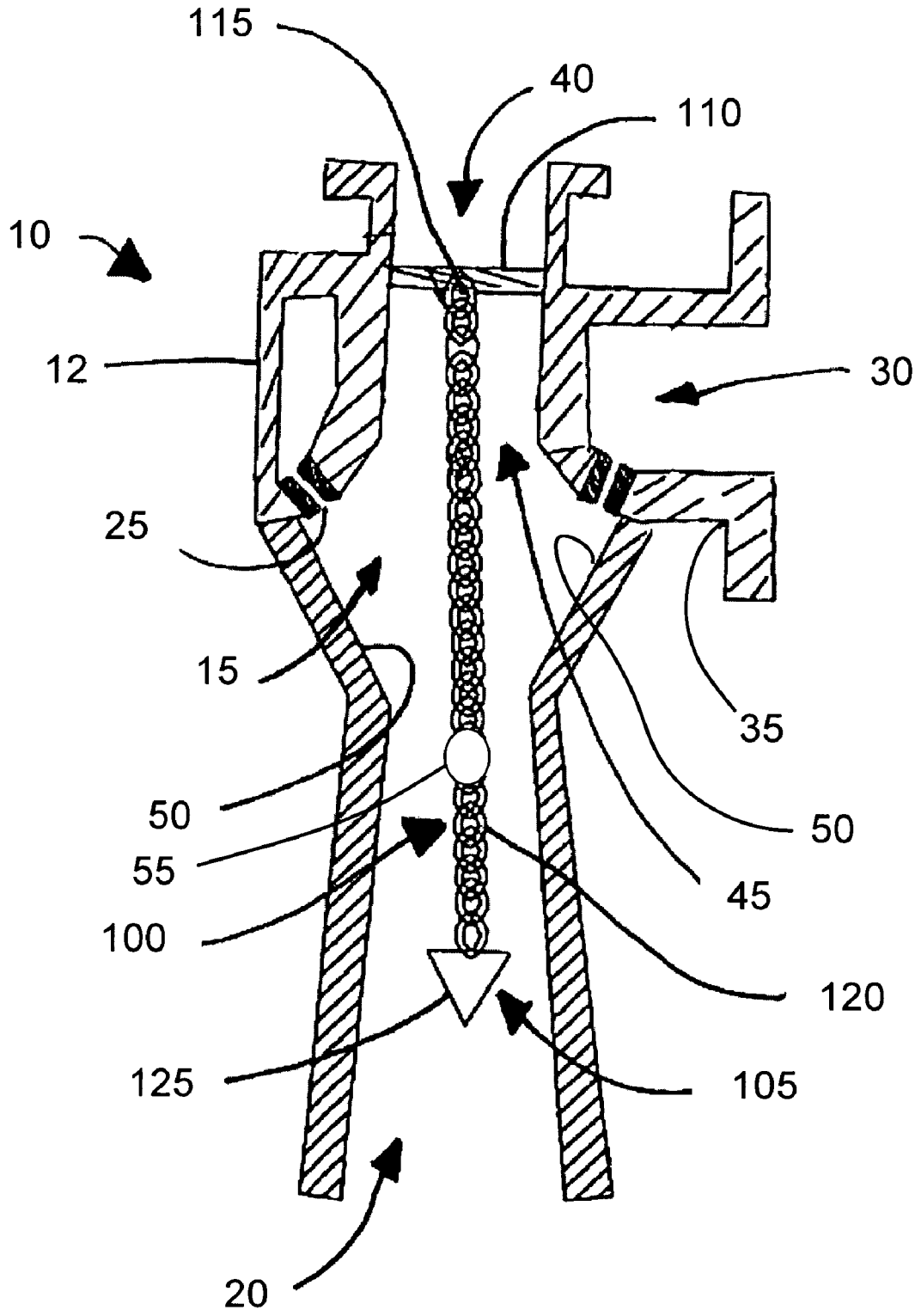
FIG. 1 illustrates a cross-sectional view of a water-powered eductor cleaner, in accordance with preferred embodiments of the present invention.

Referring now in detail to the drawing FIGURE, wherein like reference numerals represent like parts throughout the view, a water-powered eductor cleaner 10 of FIG. 1 is designed for removing accumulated matter from the inside of an eductor 12. The water-powered eductor cleaner 10 provides an eductor cleaning system 100 adapted to engage the inner walls 50 of the eductor 12 and dislodge or remove accumulated material thereon, when activated by a motive means, for example, a stream of water in combination with a vaccum.

Generally, an eductor 12 includes a chamber 15 (or venturi 15), a throat 20, a water inlet 30 in communication with a water nozzle 25, and a material intake 40. In use, a water source is provided from the water inlet 30 to the water nozzle 25 where a pressurized water stream is ejected into the chamber 15. Water nozzle 25 has flange 35 as a connection point to the water supply piping. The high velocity water moving through the chamber 15 causes a low-pressure area to build in an upper portion 45 of the chamber 15. The low-pressure area creates a vacuum effect, such that particulate matter, gas, or liquid provided by the material intake 40 is drawn from the eductor chamber 15 towards the throat 20 of the chamber 15. The particulate matter within the chamber 15 is then removed from the eductor 12 and provided to an external storage area.

For example and not limitation, in coal fired power plants, an eductor 12 moves coal fly ash from small collection hoppers to larger external storage areas or an ash pond. The ash and air enter the eductor 12 through the material intake 40. Both ash and air enter the material intake 40, because moving air is used as the transport media to push the ash through the piping system. Air is the media normally entrained with the ash to aid transportation.

The coal fly ash typically contains calcium carbonate that can become sticky when mixed with water. Within the eductor 12, the coal fly ash and water mixture can adhere to the inner wall 50 of the eductor chamber 15. Over a period of time, the accumulation of the coal fly ash build-up on the inside wall 50 of the eductor chamber 15 clogs or plugs-up the water nozzle 25 of the eductor 12. As the coal fly ash continues to build-up in the throat 20 of the eductor 12, additional coal fly ash and other particulate matter cannot be removed from the eductor chamber 15. Accordingly, the eductor 12 cannot effectively move the fly coal ash or other particulate matter from the hoppers to an external storage area. The eductor 12, therefore, must be taken out of service for cleaning.

The present invention, however, reduces, if not prevents, the accumulation of particulate matter (such as coal fly ash) on the inner walls 50 of the eductor chamber 15. The eductor cleaning system 100 includes a pendulum cleaning device 105 adapted to remove accumulated material from the inner walls 50 of the eductor 12 when activated to move/undulate. The eductor cleaning system 100 utilizes the high-pressured water stream injected into the eductor chamber 15, in combination with the vacuum created by the low-pressure area located in the upper portion 45 of the chamber 15, as a motive means or energy source to activate. More particularly, the combination of the high-pressured water stream and the vacuum within the eductor chamber 15 causes the pendulum cleaning device 105 to undulate, such that the pendulum cleaning device 105 engages the inner side walls 50 of the eductor chamber 15.

As the pendulum cleaning device 105 engages (e.g., strikes) the inner side wall 50 of the eductor chamber 15, the pendulum cleaning device 105 effectively removes or knocks off accumulated material in proximity to contact. Accordingly, the pendulum cleaning device 105 cleans the eductor 12, thereby ensuring that the eductor 12 continues to function efficiently and effectively. As the eductor 12 need not be taken out of service for cleaning when using the present invention, the transfer of particulate matter can continue uninterrupted by down time. Also, the eductor cleaning system 100 eliminates the need for manually removing the accumulated particulate matter using a rod or hard brush. Consequently, a serviceperson is not subject to the space-limiting and fall hazard environment of the eductor 12, as would be required if the eductor 12 was taken out of service for cleaning.

In a preferred embodiment of the present invention, the pendulum cleaning device 105 comprises a mounting bar 110, a pivot attachment point 115, a chain 120, and a pendulum weight 125. The mounting bar 110 is positioned in the upper portion 45 of the chamber 15, for example, near the material intake 40. The pivot attachment point 115 is in communication with the mounting bar 110, such that the pivot attachment point 115 is adapted to maintain a first end of the chain 120 to the mounting bar 110. The pivot attachment point 115 effectively creates a pendulum of the chain 120, wherein the chain 120 can swing or pivot from the pivot attachment point 115. This communication can be fixedly, or removably secured, to effectuate chain replacement.

The chain 120, or an elongated, flexible device, extends downwardly a predetermined length from the pivot attachment point 115 into the chamber 15 of the eductor 12. A second end of the chain 120 is adapted to engage a pendulum weight 125. The pendulum weight 125 generally maintains the chain 120 in a fully extended position, such that the chain 120 extends downwardly into the chamber 15 of the eductor 12. As the vacuum flow created within the eductor chamber 12 and the high-pressured water stream causes the chain 120 to undulate, the pendulum weight 125 attempts to maintain the chain 120 in the downwardly extending position. Further, the pendulum weight 125 allows the chain 120 to build momentum during undulation. In other words, the added weight at the bottom of the chain 120, once in motion, assists in keeping the chain 120 in motion as the chain 120 swings or undulates at the pivot attachment point 115.

Preferably, the pendulum weight 125 has a triangular shape, as illustrated in FIG. 1. It has been found that the triangular shaped pendulum weight 125 works best to remove the accumulated material on the side walls 50 of the chamber 15. Although, one skilled in the art would appreciate that many other shapes can be used for the pendulum weight 125.

As described above, the high-pressured water stream injected into the chamber 15 and the low-pressure area creating a vacuum within the eductor chamber 15 causes the chain 120 and pendulum weight 125 to undulate. As the chain 120 moves within the chamber 15, the chain 120 and pendulum weight 125 strike the inner side walls 50 of the eductor 12, thereby removing or knocking off accumulated particulate material. Accordingly, the eductor 12 is self-cleaning and need not be taken out of service for manual removal of the accumulated material. The removed particulate material can easily pass by or through the chain 120 and into the throat 20 of the eductor 12, where the particulate matter is transported from the chamber 15 to the external storage area.

One skilled in the art would recognize that the water-powered eductor cleaner 10 can be used in a variety of industries where dust or particulate matter needs to be moved or removed. For example and not limitation, the water-powered eductor cleaner 10 can be used in the energy industry, mining industry, and cement industry.

While the present invention has been described utilizing a chain 120, one skilled in the art will recognize that other items can be used, such as, but not limited to, cords, ropes, wire, cables, lines, belts, or other flexible devices. Moreover, one skilled in the art will recognize that the length, weight, and quality of the chain 120 will depend on the type of environment used in the industry. For example, the length of the chain 120 may vary depending on the depth of the eductor 12 in which the chain 120 is to be used or the location of the accumulating material within the eductor 12.

Depending on the type of material used within the eductor 12, certain particulate material can be more corrosive to the chain 120 than other particulate matter. In a preferred embodiment, the chain 120, pivot attachment point 115, and pendulum weight 125 are made of a non-corrosive or corrosion-resistant material. For example and not limitation, the chain 120, pivot attachment point 115, and pendulum weight 125 can be made of plastic, metal, fabric, or other suitable material. Further, the chain 120, pivot attachment point 115, and pendulum weight 125 can be coated with a material resistant to a corrosive environment. In fact, in a preferred embodiment, and in order to protect the side walls 50 from the undulating chain 120, the chain 120 can be coated with an outer layer of plastic 55, as the plastic layer 55 reduces the damage to the side walls 50. Further, the plastic layer of the chain 50 can help prolong the life of the chain 50, as the plastic layer reduces the chance of the chain rusting.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A self cleaning eductor comprising:

an eductor comprising:

a chamber comprising:

an upper portion comprising an inner side wall and a first diameter;

a throat portion positioned beneath the upper portion, the throat portion comprising an inner side wall and a second diameter, wherein the second diameter is less than the first diameter; and a lower portion comprising an inner side wall and a third diameter, wherein the third diameter is larger than the second diameter;

a water inlet in communication with a water nozzle for providing a water supply into the upper portion of the chamber; and a material intake positioned above the water inlet for providing particulate matter into the chamber; and a mounting bar above the water inlet and in the path of the material intake of the eductor;

an elongated, flexible device having a first end and a second end, the first end extending from the mounting bar, and the second end carrying a pendulum weight, wherein when water from the water supply enters the chamber through the water inlet, the water activates the movement of the elongated, flexible device sufficient enough such that a portion of the elongated, flexible device strikes the inner side wall of the upper portion, the inner side wall of the throat portion, and the inner side wall of the lower portion dislodging particulate matter accumulated thereon in proximity to the location of the strikes.

2. The self cleaning eductor of claim 1, wherein the elongated, flexible device is releasably secured to the mounting bar.

3. The self cleaning eductor of claim 1, wherein the elongated, flexible device is fixedly secured to the mounting bar.

4. The self cleaning eductor of claim 1, wherein the water supply is pressurized.

5. The self cleaning eductor of claim 1, further comprising a pivot attachment point at the first end of the elongated, flexible device for connecting the elongated, flexible device to the mounting bar.

6. The self cleaning eductor of claim 1, wherein the elongated, flexible device is a chain, rope, cable, line, or belt.

7. The self cleaning eductor of claim 6, wherein a portion of the elongated, flexible device is covered with plastic to prevent the rusting of the elongated, flexible device and to prevent damage of the inner side wall.

8. The self cleaning eductor of claim 1, wherein the pendulum weight comprises a triangular shape, wherein a top surface of the pendulum is approximately perpendicular to the flow of water from the water inlet.

9. The self cleaning eductor of claim 1, wherein the water activates the elongated, flexible device such that the pendulum weight strikes a location on the inner side wall.

10. The self cleaning eductor of claim 1, wherein the first end of the elongated, flexible device is mounted in proximity to the center of the material intake of the eductor.

11. The self cleaning eductor of claim 10, wherein the second end of the elongated, flexible device extends beneath the throat portion of the eductor, such that a side wall in the lower portion of the chamber can be struck by a portion of the elongated, flexible device.

12. The self cleaning eductor of claim 11, wherein the pendulum weight comprises an upper end, and wherein the upper end of the pendulum weight comprises a flat surface, and wherein the flat surface of the pendulum weight is approximately perpendicular to the flow of water through the eductor.

* * * * *